United States Patent [19]

Yuhara

[11] Patent Number: 4,589,431

[45] Date of Patent: May 20, 1986

[54] VANITY CASE

[75] Inventor: Yukitomo Yuhara, Abiko, Japan

[73] Assignee: Yoshida Industry Co., Ltd., Tokyo, Japan

[21] Appl. No.: 589,669

[22] Filed: Mar. 13, 1984

Related U.S. Application Data

[63] Continuation-in-part of Ser. No. 356,147, Mar. 8, 1982, abandoned.

[30] Foreign Application Priority Data

Aug. 24, 1981 [JP] Japan ..... 56-124122[U]

[51] Int. Cl.[4] ..... A45D 33/00

[52] U.S. Cl. ..... 132/83 R

[58] Field of Search ..... 132/83 R

[56] References Cited

U.S. PATENT DOCUMENTS 4,345,607 8/1982 Contreras ..... 132/83 R 4,483,355 11/1984 Yuhara ..... 132/83 R

*Primary Examiner*—Gregory E. McNeill

*Attorney, Agent, or Firm*—Wenderoth, Lind & Ponack

[57] ABSTRACT

A vanity case includes a receptacle and a cover member. Integrally provided in a rear end portion of either the receptacle or the cover member is a horizontal pin adapted to be snugly fitted in an enlarged section of a groove formed on a rear end of the other member whereby the receptacle and the cover member are hinged together.

5 Claims, 5 Drawing Figures

VANITY CASE

BACKGROUND OF THE INVENTION

This application is a continuation-in-part of the application Ser. No. 356,147 filed on Mar. 8, 1982, now abandoned.

This invention relates to an improvement of a vanity case made of plastic and, more particularly, to a vanity case having a receptacle for containing cosmetic material therein and a cover member connected at a rear end thereof to the receptacle so as to close the latter by an engagement of latch tongues provided at the front ends of the receptacle and the cover member.

In the conventional vanity case of the type set forth above, the receptacle and the cover member are hinged together by a metal pivot pin formed separately from the receptacle and cover members. For receiving this pivot pin, the rear end of the vanity case is pierced by a pin hole which extends between both side walls of the assembled case. For the assembly of the vanity case, after inserting a hinge block formed on, for example the cover member, into a recess provided in, also for example the receptacle, the pivot pin must be driven into the holes then in alignment. Thus, the assembly of the conventional vanity case involves considerably difficulties, which prevent a user from replacing the receptacle with a new one containing cosmetic material of the same or other type.

Furthermore, the pivot pin has to be fitted in the hole so tightly that the pin will not drop out of the hole. This will by no means permit a slight movement of the pin relative to the vanity case. On the other hand, a too tight engagement of the latch tongues frequently occurs due to irregularities involved in the plastic molding of the members. However, such a tight engagement at the front end can not be accommodated by the rear hinge portion, and therefore the engagement remains irregular. Such a tight engagement also increases the fatigue of the plastic latch tongues.

Also, the pivot pin tightly fitted in the hole is intended to maintain the cover member in a desired angle with respect to the receptacle member when the cover member is opened. For this purpose, the pivot pin and the pin hole must have very high accuracy of dimensions. Nevertheless, long use of the vanity case tends to reduce frictional resistance between the pin and the hole thereby extinguishing the above function In addition, the pivot pin, both ends of which are exposed at the side walls of the case, detracts from the external appearance of the vanity case, having a smooth and sometimes decorated surface, to a considerable extent.

Accordingly, it is an object of the present invention to provide an improved vanity case which can be assembled without a difficult operation of connecting a cover member to a receptacle as required in the conventional vanity case.

Another object of the present invention is to provide a vanity case which enables a user to replace a receptacle with another one containing cosmetic material of the same or other type, thereby making it unnecessary for the user to purchase an entirely new case even when the cosmetic material contained in the former receptacle is used up.

Still another object of the present invention is the provision of a vanity case in which a rear hinge portion may serve to average the tightness of engagement between latch tongues molded at a front end of the case so that fatigue of the plastic latch tongues can be reduced.

It is a further object of the present invention to provide a vanity case which may prevent decrease of frictional resistance in a connecting means thereby making it possible to maintain a cover member in a desired opening angle even after a long period of use of the case.

A further object of the present invention is to provide a vanity case which presents a good external appearance.

SUMMARY OF THE INVENTION

According to the present invention, a vanity case comprises a receptacle member molded of plastic material and adapted to contain cosmetic material, the receptacle member having a front portion having a first latch tongue, a rear portion, and an upper surface; a cover member molded of plastic material and having a front portion having a second latch tongue, a rear portion, and a lower surface; and means for hingedly connecting the rear portion of the cover member to the rear portion of the receptacle member such that the cover member is pivotable over the receptacle member between a closed portion whereat the lower surface is over the upper surface and the first and second latch tongues are in snap engagement, and an open position whereat the lower surface is spaced from the upper surface and the first and second latch tongues are out of engagement. The connecting means comprises a recess formed in a substantially central area of one of the rear portion of the receptacle member and the rear portion of the cover member, the recess being partially defined by a pair of spaced side walls; a horizontal pin integrally provided at the central area and extending between the walls of the recess; a hinge block provided at a substantially central area of the other of the rear portion of the receptacle member and the rear portion of the cover member; a groove formed in the hinge block and extending vertically when the cover member is in the closed position, the groove having an upper groove half and a lower groove half, and the groove including a horizontally extending enlarged section between the upper groove half and the lower groove half, the enlarged section having a diameter slightly smaller than a diameter of the horizontal pin. The horizontal pin is forcedly inserted into the groove and snugly fitted in the enlarged section thereof when the hinge block is positioned within the recess, thereby hingedly connecting together the cover member and the receptacle member with a frictional resistance between the horizontal pin and the enlarged section. The upper and lower groove halves enable elastic expansion of the hinge block while retaining the pin in the enlarged section, such that the cover member is capable of sufficient movement with respect to the receptacle member to avoid overly tight engagement between the first and second latch tongues due to dimensional inaccuracies therebetween.

The horizontal pin may be made of metal and integrally connected to the receptacle member or the cover member by way of a so-called insert molding at the same time the latter is molded. Alternatively, the pin may be molded of plastic integrally with the receptacle member or the cover member.

Further objects and features of the present invention will be apparent from the following detailed description of preferred embodiments thereof when taken in conjunction with the accompanying drawings, in which:

DETAILED DESCRIPTION OF THE INVENTION

Figure 1:
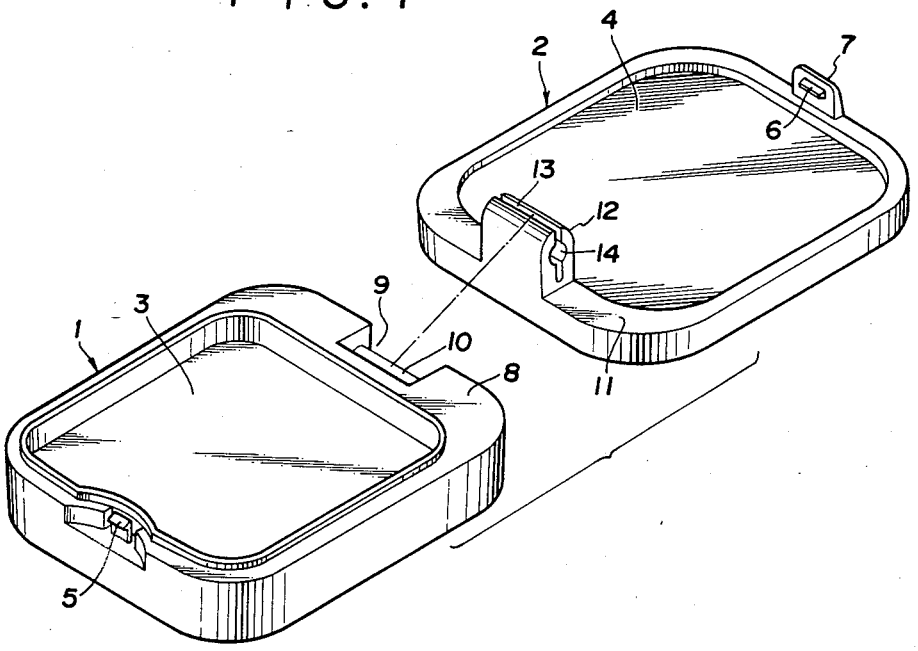
FIG. 1 is a perspective view showing a vanity case according to a first embodiment of the present invention before the assembly thereof.
Figure 3:
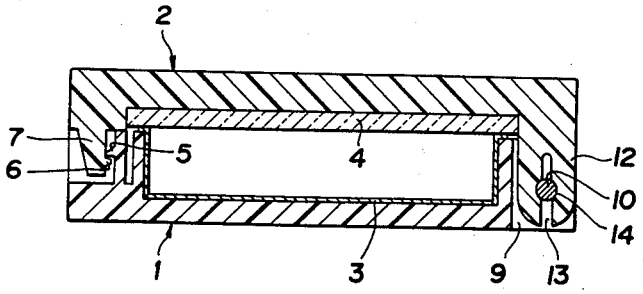
FIG. 3 is a longitudinally sectioned view of the vanity case shown in FIG. 1 but after the assembly thereof.

Referring now to a first embodiment of the present invention shown in FIGS. 1 to 4 of the drawings, a vanity case of the present invention comprises a receptacle member 1 of plastic and a plastic cover member 2 adapted to close an upper surface of the receptacle 1. Embedded in the receptacle 1 is a concave tray 3 into which cosmetic material is to be filled, while a mirror 4 is attached to an inner surface of the cover member 2 for the convenience of a user. The receptacle 1 is provided at a front end thereof with a first latch tongue 5 which will engage with a second latch tongue 6 on a pawl 7 extending downwardly from a front end of the cover member 2 when the vanity case is in the closed position.

A rear end portion 8 of the receptacle is rectangularly cut out substantially at the center part thereof to provide a recess 9. Between both side walls of the recess 9 extends a horizontal pin 10 integrally provided with the receptacle 1. This pin 10 may be made of metal and integrally connected to the receptacle 1 easily by way of insert molding at the time the receptacle is molded. Alternatively, the horizontal pin 10 may be plastic and simultaneously molded when the plastic receptacle 1 is formed.

The cover member 2 has at a rear end 11 thereof a hinge block 12 extending downwardly from the inner surface of the cover and in a position corresponding to the recess 9 of the receptacle 1. The block 12 is transversely pierced by a groove 13 which extends from a lower end of the block to the vicinity of the inner surface of the cover member 2. This groove 13 is enlarged substantially at a vertically central section 14 into which the pin 10 of the receptacle 1 can be snugly fitted. Thus, although the groove 13 may be of any suitable shape, it is necessary that at least both areas adjacent to the enlarged section 14 be narrowed so as to prevent a free movement of the pin 10 fitted in the enlarged section 14. The enlarged section 14 has a diameter smaller than that of the horizontal pin 10.

Figure 2:
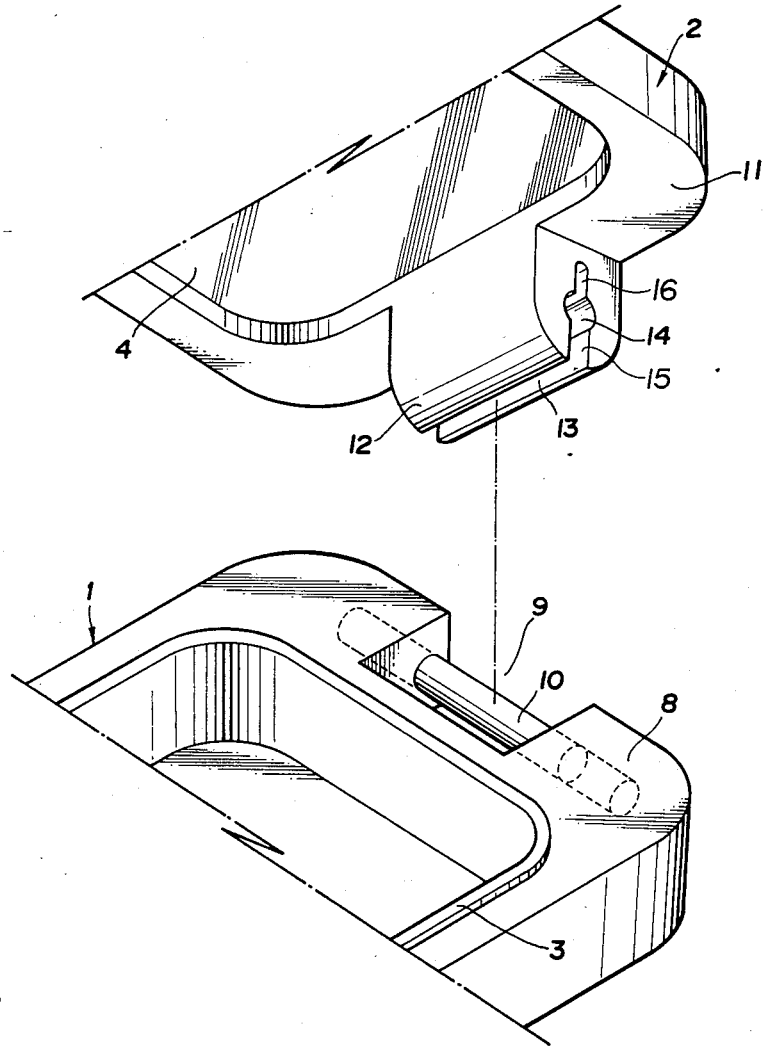
FIG. 2 is an enlarged perspective view of rear end portions of the vanity case shown in FIG. 1.
Figure 4:
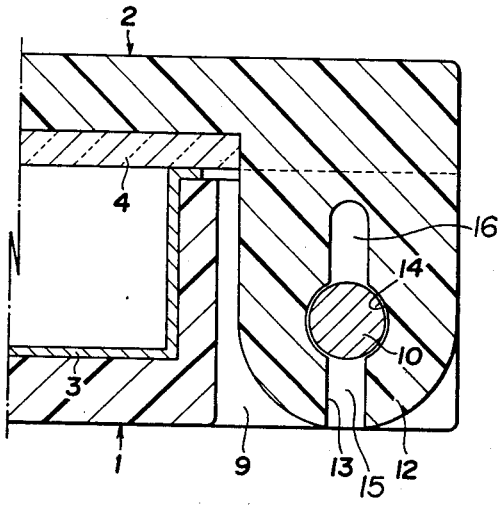
FIG. 4 is an enlarged sectional view of the rear end portion of the same vanity case.

In assembling the vanity case of the construction set forth above, the cover member 2 is held above the receptacle 1 with the hinge block 12 down as shown in FIG. 2 and then the block 12 enters the recess 9 in the receptacle 1. At this time, the horizontal pin 10 across the recess 9 can be forcedly inserted into the groove 13, elastically expanding a lower groove half 15, an upper groove half 16 and the enlarged section 14 of the groove 13 until the pin 10 is snugly fitted in the enlarged section 14 as particularly shown in FIG. 4. The pin 10 thus fitted in the section 14 pivotably connects the cover member 2 to the receptacle 1 thereby making it possible to close and open the vanity case by the engagement and disengagement, respectively, of the latching tongues as in the conventional vanity case.

As will be understood from the description above, since the receptacle 1 and the cover member 2 can be hinged together simply by forcing the pin 10 integrally provided in the receptacle into the enlarged section 14 of the groove 13 formed in the cover member 2, it is no longer necessary to drive a preformed pivot pin into pin holes provided in both receptacle and cover member after those holes are aligned as required in the conventional vanity case. Therefore, the assembly operation is greatly simplified. This simplicity enables not only the easy production of the vanity case but also a user to replace the receptacle 1 with a new one in which cosmetic material of the same or other type is filled.

Furthermore, the groove 13 serves to provide a smooth operation of the vanity case even if the engagement between latch tongues 5 and 6 is tight due to an irregularity in the shape and dimension in the molded tongues. That is, if the engagement at the front end of the case is too tight, the groove 13 in the rear end of the cover member 2 will be elastically expanded, due to the provision of the lower and upper groove halves 15 and 16, by the pin 10 fitted in the enlarged section 14 thereof. This means that the irregularity of the tongues can be accomodated by the groove 13, thereby assuring the smooth operation of the vanity case and reducing the fatigue in the latch tongue portions of the plastic material.

Further, the enlarged section 14 of the groove 13 is smaller in diameter than the horizontal pin 10, so that frictional resistance between the pin 10 and the enlarged section 14 is obtained to maintain the cover member 2 at a desired angle when opened. Since this frictional resistance is supported by the elasticity of the groove 13, it will remain without being reduced even after a long period of use of the vanity case. That is, the function of maintaining the cover 2 in a desired opening angle will continue semi-permanently. This is particularly due to the fact that the enlarged section 14 is formed between the lower groove half 15 and the upper groove half 16.

Also, the external appearance of the vanity case is improved because the pin 10 is not visible unless the cover member 2 is separated from the receptacle 1.

Figure 5:
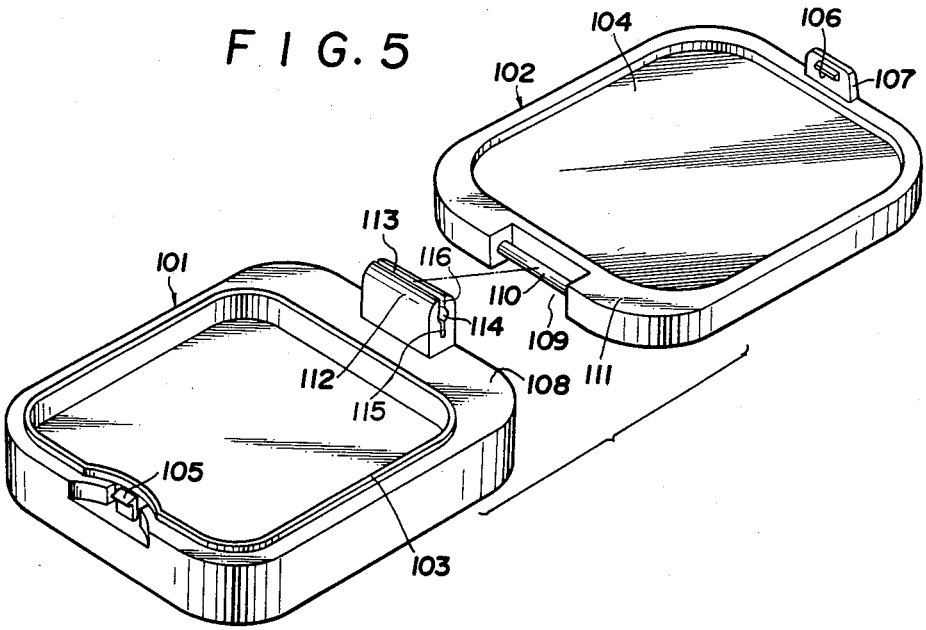
FIG. 5 is a perspective view showing a vanity case according to a second embodiment of the present invention before the assembly thereof.

Reference is now made to a second embodiment of the present invention shown in FIG. 5 in which parts the same as or corresponding to those of the first embodiment are designated by the same reference numerals but with the addition of "100". In the second embodiment, a receptacle 101 is provided at a rear end portion 108 with a hinge block 112 having a groove 113, and a cover member 102 is integrally provided at a rear end 111 with a horizontal pin 110 extending across a recess 109. As in the first embodiment, the groove 113 is enlarged substantially at a vertically central section 114 into which the pin 110 in the cover member 102 can be snugly fitted for the assembly of the vanity case. The provision of the pin 110 in the cover member 102 may facilitate the insertion of the pin into the groove 113 when the cover member is held by one hand and the receptacle 101 is held by the other hand.

Other structures of the second embodiment and the operation thereof are substantially the same as in the first embodiment.

Although the present invention has been described with reference to preferred embodiments thereof, many modifications and alterations may be made within the spirit of the present invention.

What is claimed is:

1. A vanity case comprising:

a receptacle member molded of plastic material and adapted to contain cosmetic material, said receptacle member having a front portion having a first latch tongue, a rear portion, and an upper surface;

a cover member molded of plastic material and having a front portion having a second latch tongue, a rear portion, and a lower surface; and means for hingedly connecting said rear portion of said cover member to said rear portion of said receptacle member such that said cover member is pivotable over said receptacle member between a closed position whereat said lower surface is over said upper surface and said first and second latch tongues are in snap engagement, and an open position whereat said lower surface is spaced from said upper surface and said first and second latch tongues are out of engagement, said connecting means comprising:

a recess formed in a substantially central area of one of said rear portion of said receptacle member and said rear portion of said cover member, said recess being partially defined by a pair of spaced side walls;

a horizontal pin integrally provided at said central area and extending between said walls of said recess;

a hinge block provided at a substantially central area of the other of said rear portion of said receptacle member and said rear portion of said cover member;

a groove formed in said hinge block and extending vertically when said cover member is in said closed position, said groove having an upper groove half and a lower groove half, and said groove including a horizontally extending enlarged section between said upper groove half and said lower groove half, said enlarged section having a diameter slightly smaller than a diameter of said horizontal pin;

said horizontal pin being forcedly inserted into said groove and snugly fitted in said enlarged section thereof when said hinge block is positioned within said recess, thereby hingedly connecting together said cover member and said receptacle member with a frictional resistance generated between said horizontal pin and said enlarged section, said frictional resistance being sufficient to maintain said cover member at any desired opening angle with respect to said receptacle member, and said frictional resistance being maintained semi-permanently by the elasticity provided by said upper and lower groove halves; and said upper and lower groove halves enabling elastic expansion of said hinge block while retaining said pin in said enlarged section, such that said cover member is capable of sufficient movement with respect to said receptacle member to avoid overly tight engagement between said first and second latch tongue due to dimensional inaccuracies therebetween.

2. A vanity case as claimed in claim 1, wherein said horizontal pin is made of metal and is integrally connected to said one of said receptacle member or said cover member at the same time the latter is molded.

3. A vanity case as claimed in claim 1, wherein said horizontal pin is made of plastic and is molded integrally with said one of said receptacle member or said cover member.

4. A vanity case as claimed in claim 1, wherein said recess is formed in said central area of said rear portion of said receptacle member and said hinge block extends downwardly from said lower surface of said cover member at said central area of said rear portion thereof, said groove extending from a lower end of said hinge block to a position adjacent said lower surface of said cover member.

5. A vanity case as claimed in claim 1, wherein said hinge block extends upwardly from said upper surface of said receptacle member at said central area of said rear portion thereof, said groove extending from an upper end of said hinge block to a position adjacent said upper surface of said receptacle member, and said recess is formed in said central area of said rear portion of said cover member.

* * * * *